US007469469B2

(12) United States Patent
Nakata et al.

(10) Patent No.: US 7,469,469 B2
(45) Date of Patent: Dec. 30, 2008

(54) COIL COMPONENT AND METHOD OF PRODUCING THE SAME

(75) Inventors: Toshiyuki Nakata, Matsusaka (JP); Tsunetsugu Imanishi, Toyooka (JP); Hidetoshi Hiwatashi, Takatsuki (JP); Hiroyuki Hamamoto, Toyooka (JP)

(73) Assignee: Panasonic Corporation, Osaka (JP)

( * ) Notice: Subject to any disclaimer, the term of this patent is extended or adjusted under 35 U.S.C. 154(b) by 306 days.

(21) Appl. No.: 11/259,075

(22) Filed: Oct. 27, 2005

(65) Prior Publication Data

US 2006/0049908 A1 Mar. 9, 2006

Related U.S. Application Data

(62) Division of application No. 10/657,105, filed on Sep. 9, 2003, now Pat. No. 6,985,062.

(30) Foreign Application Priority Data

Sep. 13, 2002 (JP) ..... 2002-268539
Sep. 13, 2002 (JP) ..... 2002-268540

(51) Int. Cl.
*H01F 7/06* (2006.01)

(52) U.S. Cl. ..... 29/606; 29/602.1; 29/604; 336/200; 336/225

(58) Field of Classification Search ..... None
See application file for complete search history.

(56) References Cited

U.S. PATENT DOCUMENTS 4,613,843 A * 9/1986 Esper et al. ..... 336/232
4,943,793 A * 7/1990 Ngo et al. ..... 336/83
5,017,902 A 5/1991 Yerman et al.
5,565,837 A * 10/1996 Godek et al. ..... 336/232
5,726,615 A * 3/1998 Bloom ..... 336/83
6,198,375 B1 * 3/2001 Shafer ..... 336/225
6,222,437 B1 * 4/2001 Soto et al. ..... 336/200
6,449,829 B1 * 9/2002 Shafer ..... 29/602.1
6,707,366 B2 * 3/2004 Hsu et al. ..... 336/200
6,985,062 B2 * 1/2006 Nakata et al. ..... 336/20
7,236,073 B2 * 6/2007 Matsutani et al. ..... 336/84 R

FOREIGN PATENT DOCUMENTS

| | | |
|---|---|---|
| EP | 0 662 699 A1 | 7/1995 |
| JP | 62-224905 | 10/1987 |
| JP | 2-288310 | 11/1990 |
| WO | 02/39467 | 5/2002 |

* cited by examiner

*Primary Examiner*—Paul D Kim
(74) *Attorney, Agent, or Firm*—Steptoe & Johnson LLP

(57) ABSTRACT

The present invention provides a coil component and a method for making the coil component that includes: a coil section having a through hole and composed of a plurality of ring sections formed of a metallic flat plate disposed in a plane, connected to each other at ring connecting sections, having slits formed by cutting part of the ring sections, and bent at the ring connecting sections and placed one on top of another, terminals connected to the coiled section, and a package member covering the coil section and projecting the terminals therefrom. With this structure, the coil component operates in a high-frequency region, ensuring an inductance and infinitesimal direct-current resistance while being adaptable to a large current, and can be miniaturized.

12 Claims, 15 Drawing Sheets

COIL COMPONENT AND METHOD OF PRODUCING THE SAME

This application is a divisional of application Ser. No. 10/657,105 filed Sep. 9, 2003, now U.S. Pat. No. 6,985,062, issued Jan. 10, 2006.

TECHNICAL FIELD

The present invention relates to a coil component used for various electronic apparatuses and instruments and the like.

BACKGROUND ART

A conventional coil component will be described below by reference to the drawings.

FIG. 19 is an exploded perspective view of a conventional coil component.

In FIG. 19, the coil component includes an air-core coil 22 formed by winding a plate conductor 21 formed of a foil conductor into a scroll shape, terminals 23 connected to opposite ends of the air-core coil 22 and projecting downward, a terminal block 24 on which the air-core coil 22 is placed and which has a through hole, an E type core 25 having a central magnetic leg inserted into the through hole of the terminal block 24, and an I type core 26 to be combined with the E type core 25 to form a closed magnetic circuit core.

In recent years, demanded as the coil component used for computers and the like is a coil component which operates in a high-frequency region of about 1 MHz, ensures an inductance of about 1 μH and infinitesimal direct-current resistance of several mΩ, and is adaptable to a large current of about ten-odd A.

However, according to the above conventional structure, because the plate conductor 21 is wound into the scroll shape to form the air-core coil 22 and the E type core 25 and the I type core 26 are combined with each other to form the closed magnetic circuit core, there are problems in that the coil component is difficult to adapt to a large current and cannot be miniaturized.

DISCLOSURE OF THE INVENTION

The present invention solves the above problems and it is an object of the invention to provide a coil component which operates in a high-frequency region, ensures an inductance and infinitesimal direct-current resistance, is adaptable to large current, and is miniaturized in size.

According to the invention, there is provided a coil component comprising: a coil section having a through hole and a plurality of ring sections connected to each other by ring connecting sections and formed of a metallic flat plate disposed in a plane, the ring sections being bent at the ring connecting sections and placed one on top of another; terminals connected to the coil section; and a package member which covers the coil section and from which the terminals project. Each ring section is formed of an arc-shaped portion having a slit formed by cutting a part of the ring section. The ring connecting sections are formed at end sections of the arc-shaped portions of the ring sections where the ring sections are connected to each other. The terminals are formed at end sections of the arc-shaped portions of the ring sections where the ring sections are not connected to each other.

With this structure, because the ring sections are formed of the metallic flat plate, the coil component operates in a high-frequency region, ensures an inductance and infinitesimal direct-current resistance, and is adaptable to a large current.

According to the invention, in the plurality of ring sections formed of the metallic flat plate disposed in a plane, the sum of an angle formed by center lines each connecting centers of the ring sections adjacent to each other and connected by the ring connecting section, and angles each formed by the center line of the ring section connected to the terminal and an extension line extending from the center of the ring section toward the end section formed with the terminal is approximately 180°.

Because the sum of the angle formed by the center lines each connecting the centers of the ring sections adjacent to each other and connected by the ring connecting section, and the angles each formed by the center line of the ring section connected to the terminal and the extension line extending from the center of the ring section toward the end section formed with the terminal is approximately 180°, it is easy to place the ring sections one on top of another.

Especially, in the coil section in which the ring connecting sections are bent and the ring sections are placed one on top of another, because the end sections of the arc-shaped portions of the ring sections formed with the terminals can be disposed in opposed positions with respect to the centers of the ring sections, orientations of the terminals do not need to be considered in mounting and ease of use is excellent.

At this time, because each ring connecting section can be disposed in a position at an angle of about 45° with respect to a straight line connecting the end sections formed with the terminals, miniaturization can be achieved with respect to a mounting area. In other words, if the ring connecting sections are disposed in corner portions of a square mounting portion in which the ring sections are inscribed, the mounting area can be reduced.

Moreover, if the package member is formed into a prism shape, by disposing the ring connecting sections in the corner portions, dimensions of an outside shape of the package member can be reduced and the package member can be miniaturized.

According to the invention, there is provided a method of producing a coil component including a coil section forming step for forming a coil section having a through hole and a package member forming step for covering the coil section with a package member and causing terminals connected to the coil section to project from the package member. The coil section forming step includes a ring section forming step for forming a plurality of ring sections formed of a metallic flat plate connected to each other by ring connecting sections and disposed in a plane and a bending step for bending at the ring connecting sections and placing the ring sections one on top of another. The ring section is formed of an arc-shaped portion having a slit formed by cutting a part of the ring section. Each ring connecting section is formed at an end section of the arc-shaped portion of the ring section where the ring sections are connected to each other. Each terminal is formed at an end section of the arc-shaped portion of the ring section where the ring sections are not connected to each other.

According to the producing method of the invention, the coil component which can exert the above-described operations and effects can be produced.

EMBODIMENTS

Inventions described in all the claims will be described below by using embodiments of the present invention by reference to the drawings.

First Embodiment

Figure 1:
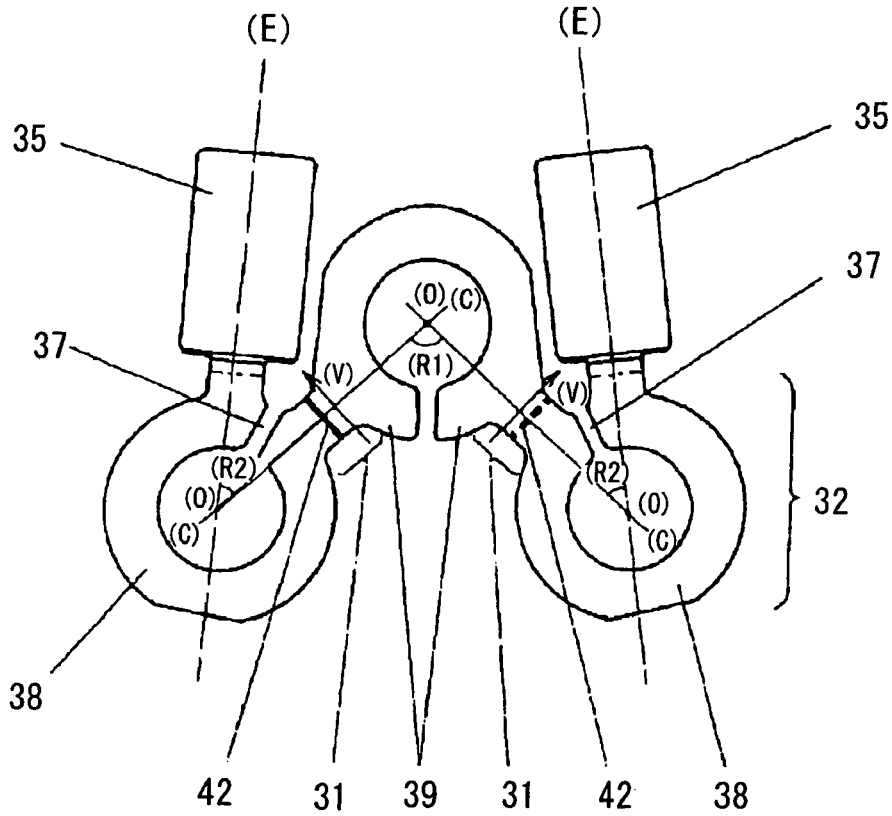
FIG. 1 is a plan view of a plurality of ring sections and terminals formed of a metallic flat plate and disposed in a plane in a coil component according to a first embodiment of the present invention.
Figure 2:
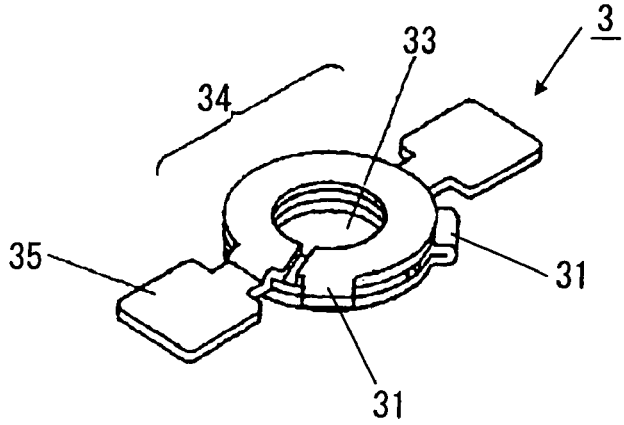
FIG. 2 is a perspective view of a coil main body of the coil component.
Figure 3:
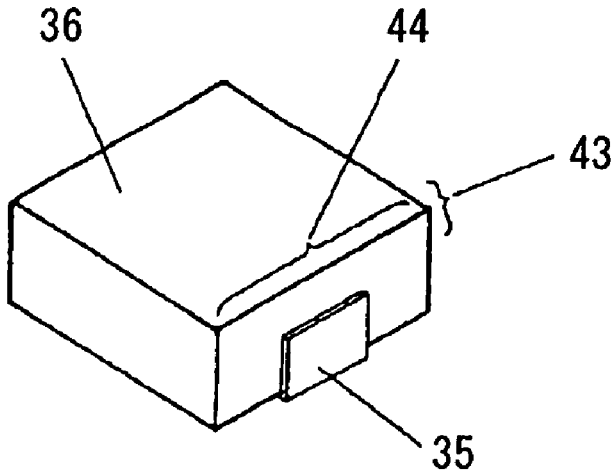
FIG. 3 is a perspective view of the coil component.
Figure 4:
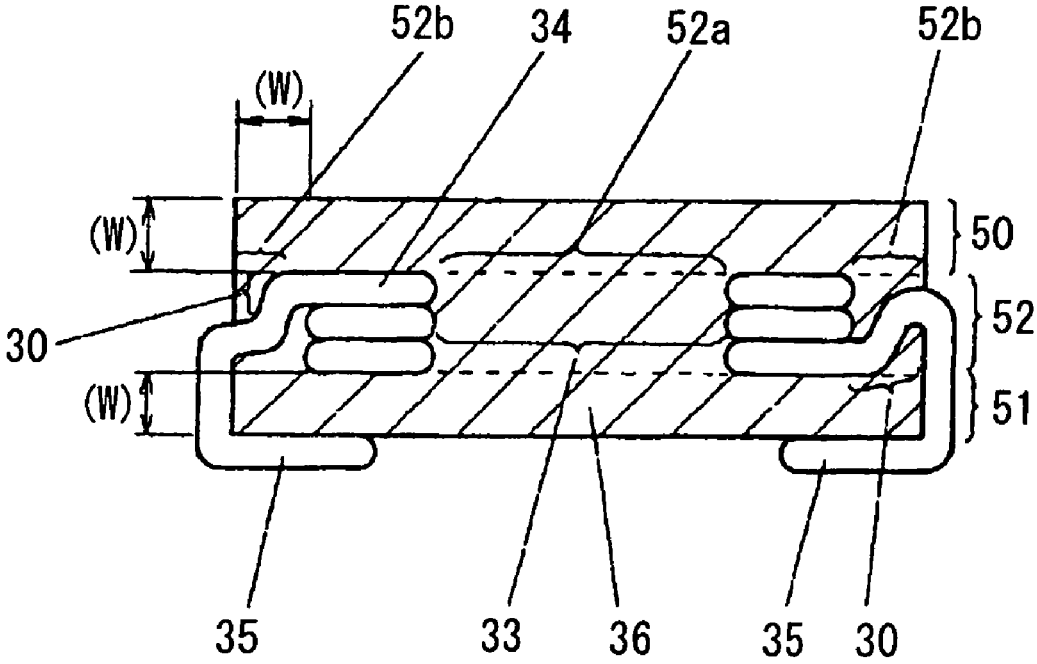
FIG. 4 is a sectional view of the coil component.

FIG. 1 is a developed view of a coil component with a plurality of ring sections and terminals formed of a metallic flat plate and disposed in a plane in a first embodiment of the invention. FIG. 2 is a perspective view of a coil main body of the coil component. FIG. 3 is a perspective view of the coil component. FIG. 4 is a sectional view of the coil component.

In FIGS. 1 to 4, the coil component in one embodiment of the invention is formed of a coil main body 3 made of a metallic flat plate and a package member 3. In the coil main body 3, a plurality of (three in FIG. 1) ring sections 32 are disposed in a plane and connected to each other through ring connecting sections 31 to be disposed in a shape of a triangle and terminals 35 are connected to end sections of the ring sections 32 at opposite ends. If the plurality of ring sections 32 are bent at the ring connecting sections 31 and placed one on top of another, a coil section 34 having a through hole 33 is formed and the terminals 35 project outward from the coil section 34. In the coil main body 3, the coil section 34 is covered with the package member 36 with the terminals 35 projecting.

The coil main body 3 formed of the metallic flat plate disposed in a plane is formed by die-cutting or etching a copper sheet and each ring section 32 has an arc-shaped portion 38 having a slit 37 formed by cutting a part of the ring section 32.

At an end section of the arc-shaped portion 38 of the ring section 32, the ring connecting section 31 connecting the ring sections 32 is formed and a projection 39 is extending toward the slit 37.

Figure 5:
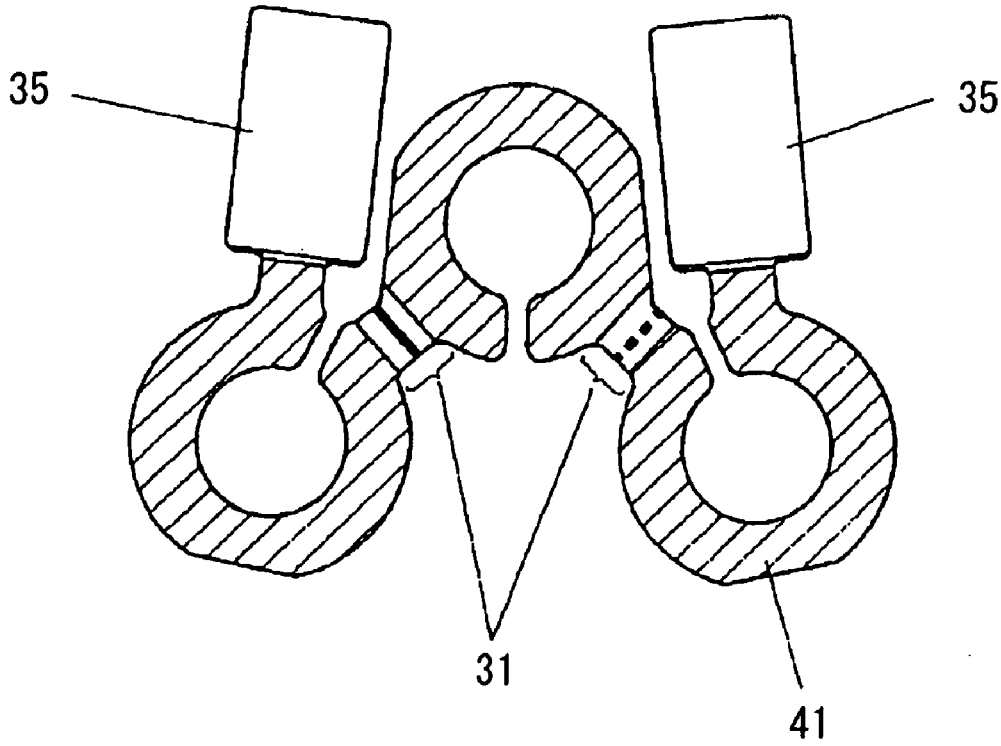
FIG. 5 is a plan view of ring sections provided with insulating coating layers and terminals, both for use in the coil component.
Figure 6:
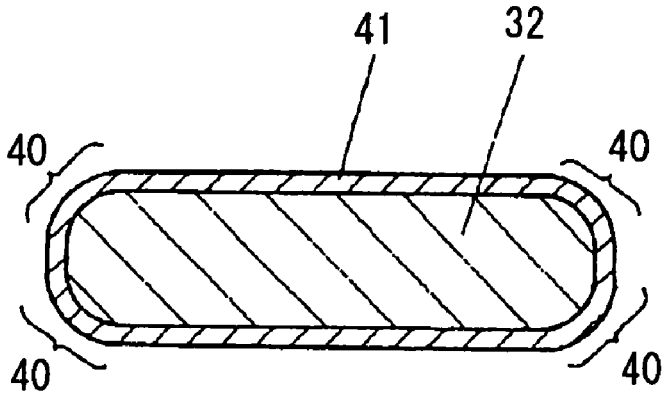
FIG. 6 is a sectional view of the ring sections provided with insulating coating layers and the terminals, both for use in the coil component.

As shown in FIGS. 5 and 6, the ring sections 32 have substantially equal outside diameters, peripheral edge portions 40 are chamfered, and the ring sections 32 excluding the ring connecting sections 31 are provided with insulating coating layers 41. Terminals 35 connected to the ring sections 32 are preferably not coated with insulating coating.

Figure 7A:
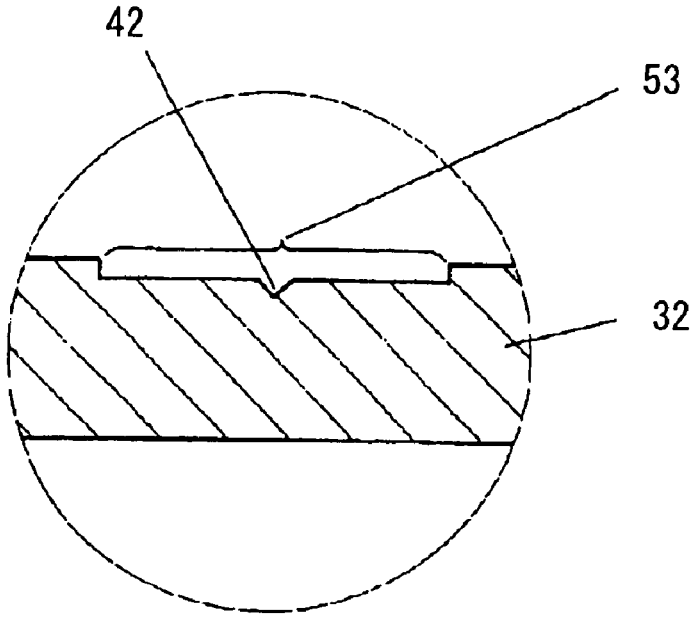
FIG. 7*a* is a sectional view of a vicinity of a ring connecting section of the ring section before bending.
Figure 7B:
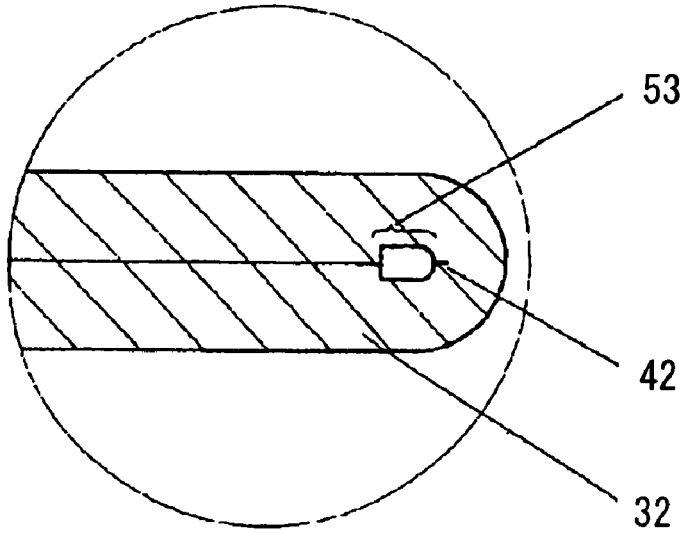
FIG. 7*b* is a sectional view of the vicinity of the ring connecting section of the ring section after bending.
Figure 8:
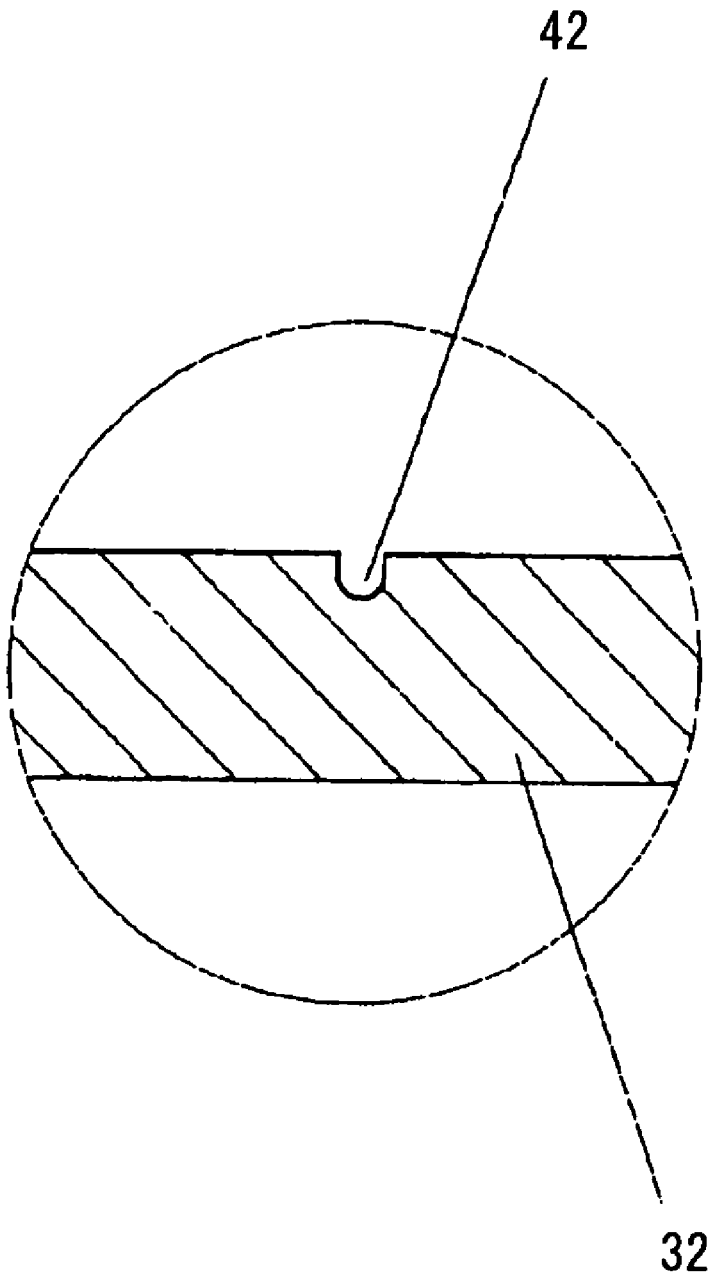
FIG. 8 is a sectional view of the vicinity of the ring connecting section of another ring section before bending.

Each ring connecting section 31 is provided with a groove 42 for bending in a direction (V) perpendicular to a center line (C) connecting centers (O) of the ring sections 32 adjacent to each other and connected by the ring connecting section 31. The groove 42 of the ring connecting section 31 has a V-shaped section and is formed in a shallow scraped recessed portion 53 as shown in FIG. 7*a*. FIG. 7*b* shows a bent state of the ring connecting section 31. Although a shape of the groove 42 may be a U shape as shown in FIG. 8, a V shape is more preferable than the U shape. Although the shallow recessed portion 53 is not formed in FIG. 8, it is preferable to form the recessed portion 53.

The rectangular terminal 35 is provided to project from an end section of the arc-shaped portion 38 of the ring section 32 where the ring sections 32 are not connected to each other. The terminal 35 is formed on an extension line (E) extending from the center (O) of the ring section 32 toward the end section of the arc-shaped portion 38 formed with the terminal 35.

As shown in FIG. 4, the terminal 35 is provided while forming a step 30 at a junction portion between the terminal 35 and the arc-shaped portion 38. As shown in FIG. 4, the step 30 formed on one terminal 35 and the step 30 formed on the other terminal 35 are arranged in such directions as to approach each other in a vertical direction when the ring sections 32 are placed one on top of another in a same phase.

These three ring sections 32 having the ring connecting sections 31 and the terminals 35 have positional relationships as shown in FIG. 1. In other words, the sum of an angle (R1) formed by the center lines (C) each connecting the centers (O) of the ring sections 32 adjacent to each other and connected by the ring connecting section 31, and angles (R2) each formed by the center line (C) of the ring section 32 connected to the terminal 35 and the extension line (E) extending from the center (O) of the ring section 32 toward the end section formed with the terminal 35 is approximately 180°. More specifically, (R1) is 96° and (R2) and (R2) are respectively 42°. Needless to say, the present invention is not limited to these values.

The package member 36 has an outside shape of a rectangular parallelepiped. In the package member 36, the ring connecting section 31 formed at one end section of the arc-shaped portion is disposed at one inter-corner portion 44 of the package member 36 and the ring connecting section 31 formed at the other end section of the arc-shaped portion is disposed at the other inter-corner portion 44 of the package member 36.

A method of producing the coil component having the above structure is as follows as shown in FIGS. 9*a* to 9*g*.

Figure 9A:
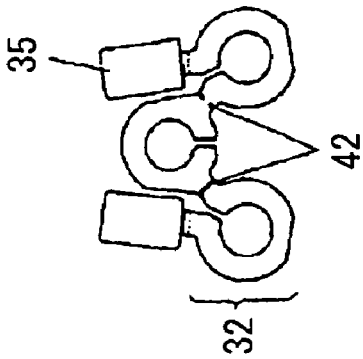
FIGS. 9*a* to 9*g* are process diagrams of producing the coil component.
Figure 9B:
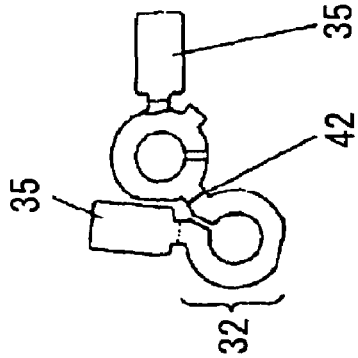
Figure 9C:
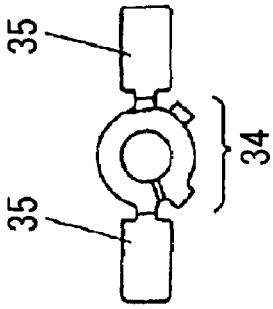

First, the coil main body including the coil section 34 having the through hole 33 is formed in the above manner (a step of forming the coil main body) (FIGS. 9*a* to 9*c*).

This step consists of a plate body producing step and a bending step of the coil main body.

First, the plurality of ring sections 32 and the terminal sections 35 connected to each other by the ring connecting sections 31 and formed of the metallic flat plate disposed in a plane are formed by die-cutting or etching a copper sheet (a step of producing the plate body of the coil main body).

Next, the plate body is bent at the ring connecting sections 31 and the ring sections 32 are placed one on top of another (a bending step) (FIGS. 9*b* and 9*c*).

Figure 9D:
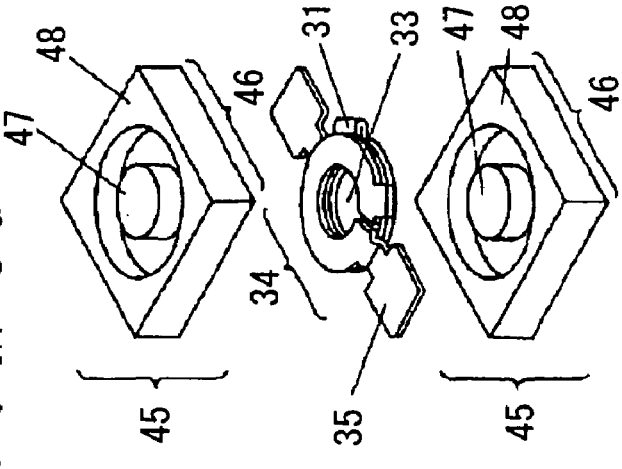
Figure 9E:
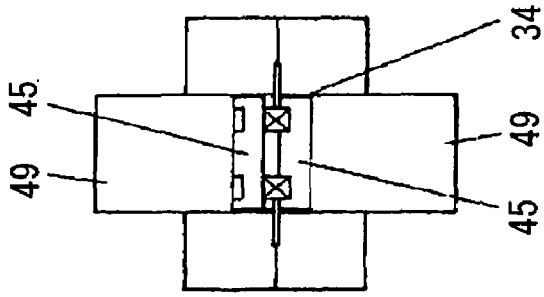
Figure 9F:
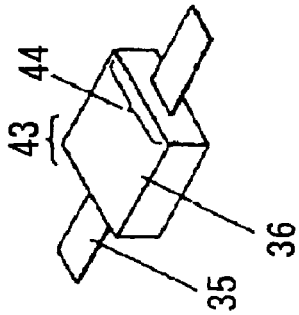

Second, the coil section 34 is covered with the package member 36 (a step of forming the package member) (FIGS. 9*d* to 9*f*). The step of forming the package member consists of a step of forming compacted powder bodies, a step of re-pressure forming, and a thermosetting step.

First, a binder including thermosetting resin and magnetic powder are mixed in a non-heated state such that the thermosetting resin does not set completely and are pressure-formed in the non-heated state to form two compacted powder bodies 45 (a step of forming compacted powder bodies).

The compacted powder body 45 is formed into a pot shape having an E sectional shape by heaping a middle leg portion 47 and an outer leg portion 48 on a square back portion 46. The back portion 46 is formed into a high hardness portion such that the compacted powder body 45 does not lose its shape in the re-pressure forming. The middle leg portion 47 and the outer leg portion 48 are formed into the low hardness portion such that the compacted powder body 45 loses its shape in the re-pressure forming.

The low hardness portion and the high hardness portion are formed of a portion (low hardness portion) in which a density of the compacted powder body 45 is low and a portion (high hardness portion) in which the density is high and the low hardness portion has such a hardness that the compacted powder body loses its shape under pressure of several kg/cm$^2$.

Here, the hardness with which the compacted powder body 45 loses its shape refers to the hardness with which the compacted powder body 45 crumbles into particles of the magnetic powder. In the high hardness portion having such a hardness that the compacted powder body 45 does not lose its shape, hardness with which the compacted powder body 45 crumbles into blocks (lumps) (i.e., not into the particles of the magnetic powder) is not included in a range of the hardness with which the compacted powder body 45 loses its shape.

Next, the back portion 46 of one compacted powder body 45 is placed on one face (upper face) of the coil section 34 and the middle leg portion 47 of the other compacted powder body 45 is inserted into the through hole 33 of the coil section 34 from the other face (lower face) of the coil section 34.

These compacted powder bodies 45 and the coil main body are fitted into a metal mold 49 having a prism-shaped inside cavity. The ring connecting sections 31 are disposed in corner portions of the metal mold 49. The terminals 35 are disposed at midpoint positions between the corner portions of the metal mold 49 and project from the metal mold 49.

One metal mold 49 out of the upper and lower two metal molds 49 presses the middle leg portion 47 and the outer leg portion 48 which are the low hardness portions of the one compacted powder body 45 and the other metal mold 49 presses the back portion 46 which is the high hardness portion of the other compacted powder body 45 to re-pressure form the compacted powder bodies 45 (the step of re-pressure forming).

From one face side (an upper face side of the perspective view in FIG. 9*d*) of the coil section 34, the middle leg portion 47 and the outer leg portion 48 which are the low hardness portions of the one compacted powder body 45 (the upper compacted powder body in FIG. 9*d*) are pressed while crumbling. At the same time, the back portion 46 which is the high hardness portion of the one compacted powder body 45 and which faces an inner wall face of the through hole 33 of the coil section 34 sinks in shape of block into the through hole 33 of the coil section 34 and the back portion 46 of the compacted powder body 45 facing the terminals 35 sink in shape of block toward the terminals 35.

From the other face side (a lower face side of the perspective view in FIG. 9*d*) of the coil section 34, the middle leg portion 47 and the outer leg portion 48 which are the low hardness portions of the other compacted powder body 45 (the lower compacted powder body in FIG. 9*d*) are pressed while crumbling. The middle leg portion 47 and the outer leg portion 48 of the other compacted powder body 45 are pressed as described above and face the back portion 46 of the one compacted powder body 45 which has sunk in shape of block into the through hole 33 of the coil section 34 and toward the terminals 35. At the same time, gaps between the coil section 34 and the back portions 46 of the compacted powder bodies 45 are filled with the crumbled middle leg portions 47 and outer leg portions 48 of the one compacted powder body 45 and the other compacted powder body 45.

As described above, because the one and the other compacted powder bodies are pressed simultaneously from above and below toward the coil section 34 in the metal mold 49, the one and the other compacted powder bodies are formed into the integral block-shaped package member 36 while sandwiching the coil section 34 between them.

As shown in FIG. 4, a thickness (w) of a skin of the package member 36 in which the coil section 34 is encapsulated is smaller than a diameter of the through hole 33 of the coil section 34. In an upper face portion 50 of the package member 36 corresponding to an upper portion of the coil section 34, a lower face portion 51 of the package member 36 corresponding to a lower portion of the coil section 34, and an intermediate portion 52 of the package member 36 corresponding to a height portion of the coil section 34, a density of the upper face portion 50 and a density of the lower face portion 51 are higher than a density of the intermediate portion 52 (the density of the upper face portion 50 and the density of the lower face portion 51 are 5.0 to 6.0 g/cm$^3$ and the density of the intermediate portion 52 is 85% to 98% of them).

Especially in the intermediate portion 52, in an inner intermediate portion 52*a* corresponding to an inside of the through hole 33 of the coil section 34 and an outer intermediate portion 52*b* corresponding to an outside portion of an outer peripheral face of the coil section 34, a density of the outer intermediate portion 52*b* is higher than a density of the inner intermediate portion 52*a*.

Then, the package member 36 is formed by heat forming such that the thermosetting resin sets completely (the thermosetting step).

Figure 9G:
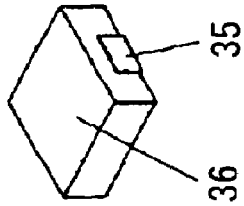

Lastly, the terminals 35 are bent along the package member 36 (FIG. 9*g*).

The coil component having the above structure has the following operations.

Because the ring sections 32 of the, coil section 34 is formed of a metallic flat plate, the coil component operates in a high-frequency region, ensures an inductance and infinitesimal direct-current resistance, and is adaptable to a large current.

In the ring sections 32 formed of the metallic plate disposed in a plane, the sum of the angle (R1) formed by the center line (C) connecting the centers (O) of the ring sections 32 connected by the ring connecting section 31 and adjacent to each other and the center line (C) and the angles (R2)(R2) each formed by the center line (C) of the ring section 32 connected to the terminal 35 and the extension line (E) extending from the center (O) of the ring section 32 toward the end section formed with the terminal 35 is 180°. Therefore, it is easy to place the ring sections 32 one on top of another.

The ring sections 32 have substantially equal outside diameters and are formed by etching or die cutting. Therefore, the ring sections 32 can be formed easily with accuracy and variations in characteristics of the ring sections 32 can be suppressed.

Figure 10A:
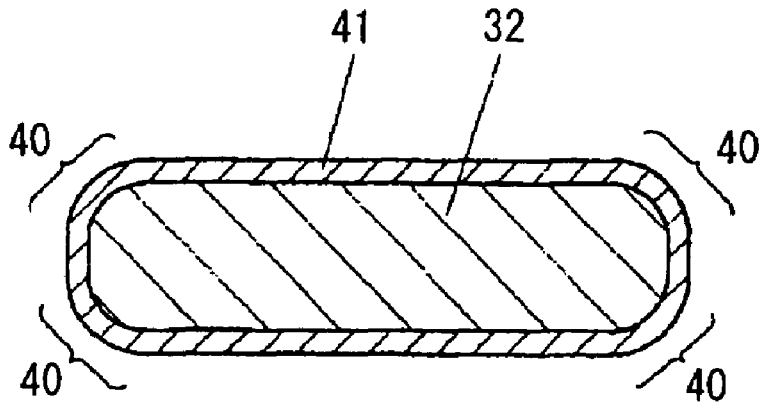
FIG. 10*a* is a sectional view of the ring section of the coil component provided with the insulating coating layer and chamfered.
Figure 10B:
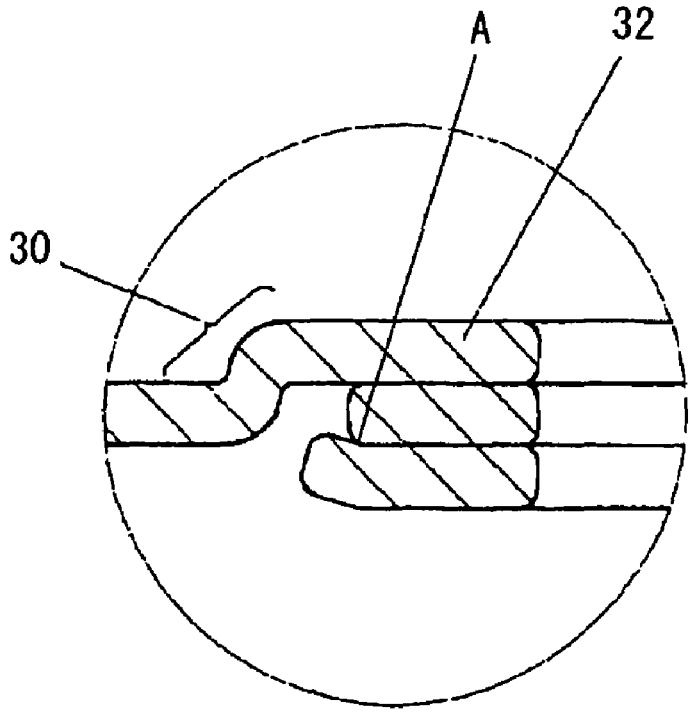
FIG. 10*b* is a sectional view of a vicinity of outer peripheries of the ring sections when the ring sections are placed one on top of another.
Figure 11A:
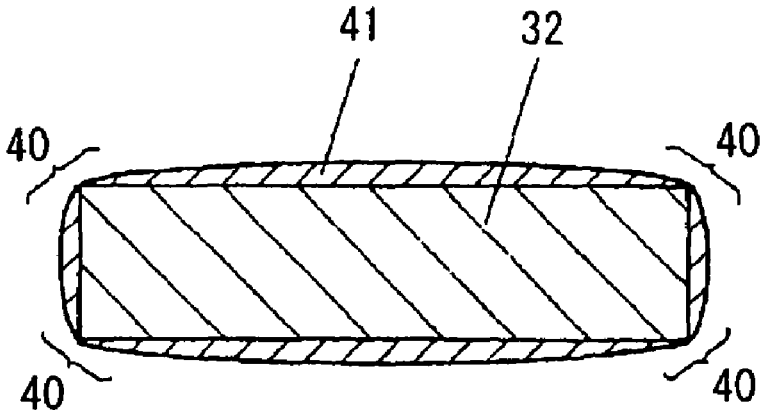
FIG. 11*a* is a sectional view of the ring section provided with the insulating coating layer and not chamfered.
Figure 11B:
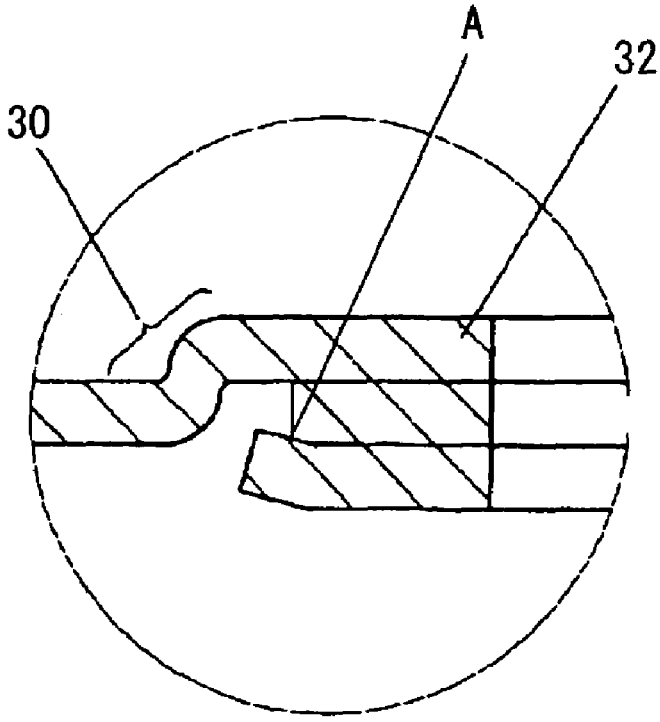
FIG. 11*b* is a sectional view of a vicinity of outer peripheries of the ring sections when the ring sections are placed one on top of another.

Because the peripheral edge portions 40 are chamfered, the insulating coating layer 41 can be formed evenly around the ring section 32 as shown in FIG. 10*a*. As shown in FIG. 10*b*, if stress or the like is applied from above and below when the ring sections 32 are placed one on top of another, damage (peeling of the coatings at a portion A) to the adjacent upper and lower ring sections 32 by each other can be suppressed by the peripheral edge portions 40 of the ring sections 32. If the peripheral edge portions 40 are not chamfered, the insulating coating layer 41 cannot be formed evenly around the ring section 32 as shown in FIG. 11*a* and the upper and lower ring sections 32 are likely to be damaged by each other (peeling of the coatings at a portion A) when the ring sections 32 are placed one on top of another as shown in FIG. 11*b*.

Figure 12A:
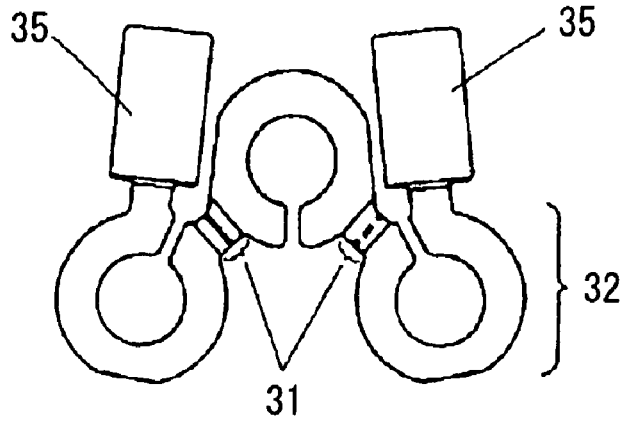
FIGS. 12*a* to 12*c* are process diagrams of bending the ring sections in the producing process of the coil component.
Figure 12B:
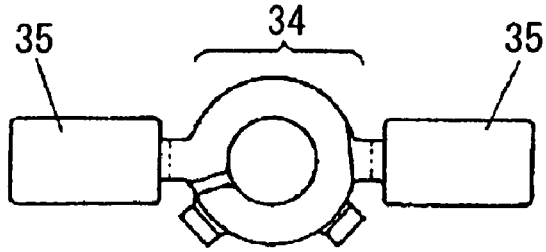
Figure 12C:
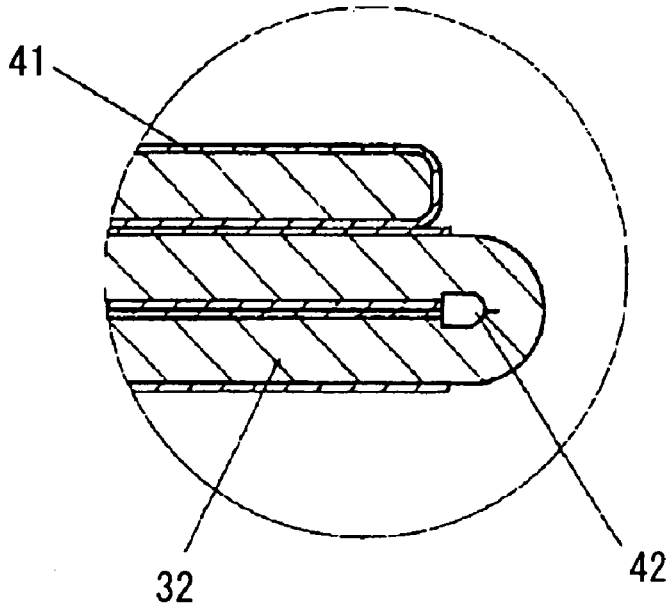

Because the ring sections 32 excluding the ring connecting sections 31 are provided with the insulating coating layers 41, a short circuit in the ring sections 32 placed one on top of another can be suppressed. Especially, the insulating coating layers 41 are provided while leaving spaces at the ring connecting sections 31, the insulating coating layers 41 do not get ripped when the ring connecting sections 31 are bent and a deterioration of characteristics due to a rip of the insulating coating layer 41 can be suppressed. As shown in FIGS. 12*a* to 12*c*, because the insulating coating layer 41 is not formed at a bent portion when the ring connecting sections 31 are bent as especially shown in FIG. 12*c*, the insulating coating layer 41 does not expand or contract due to the bending (if the insulating coating layer 41 is bent, degrees of expansion and contraction on inner and outer sides of the ring connecting sections 31 are different from each other) and ripping of the insulating coating layer 41 can be suppressed.

Figure 13A:
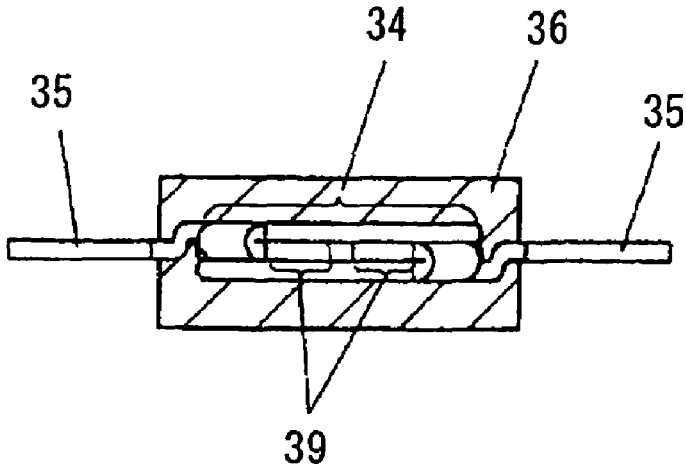
FIG. 13*a* is a sectional view showing a state in which the ring sections provided with extending projections are deformed after forming of a package member.
Figure 13B:
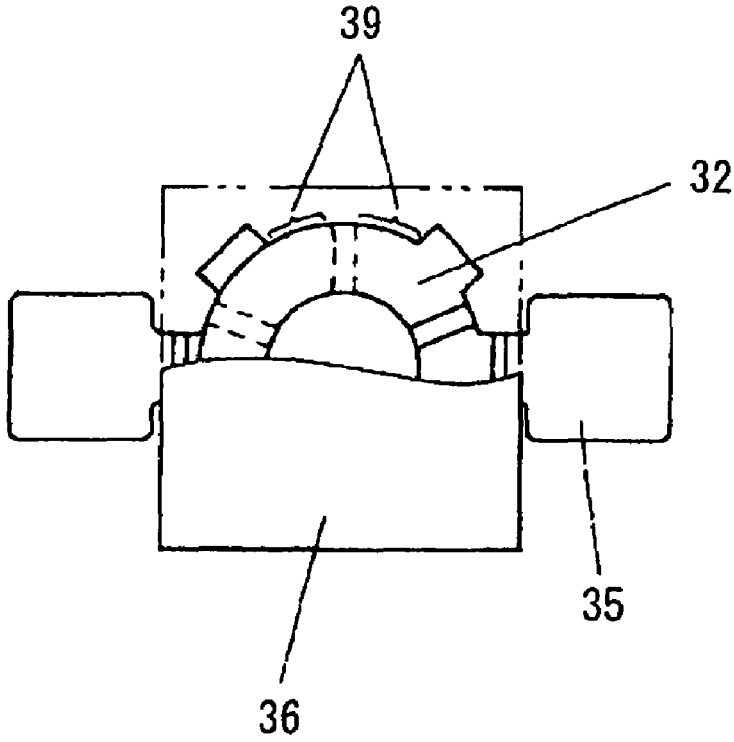
FIG. 13*b* is a plan view of the ring section.
Figure 14A:
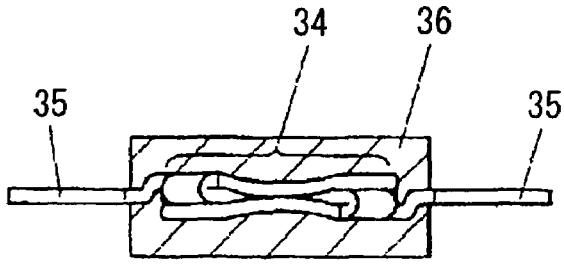
FIG. 14*a* is a sectional view showing a state in which the ring sections not provided with the extending projections are deformed after forming of a package member.
Figure 14B:
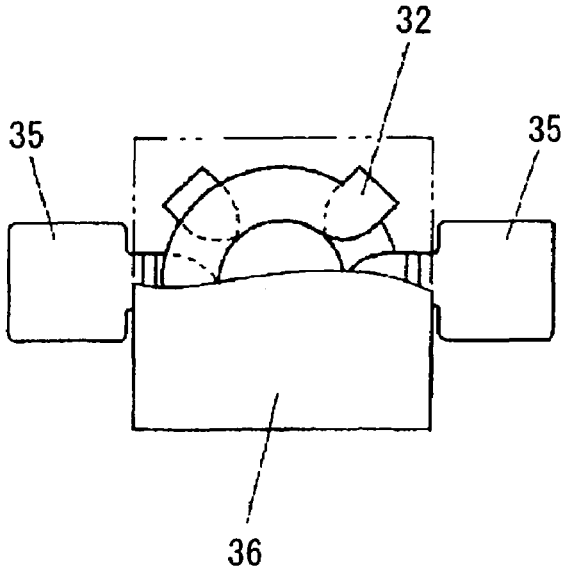
FIG. 14*b* is a plan view of the ring section.
Figure 15:
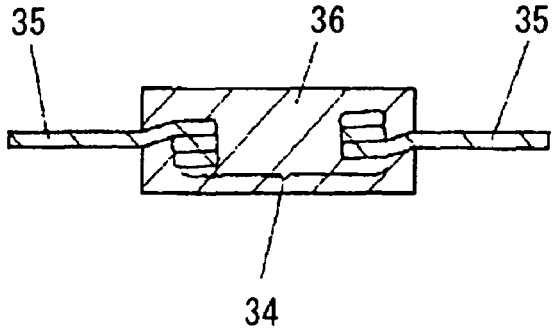
FIG. 15 is a sectional view of the coil component without steps.

The projections 39 are formed at the end sections of the arc-shaped portions 38 of the ring sections 32 connected to each other to extend toward the slits 37. Therefore, even if stress or the like is applied from above and below when the ring sections 32 are placed one on top of another, corresponding portions of the upper and lower ring sections 32 are supported by the projections 39. As a result, the upper and lower adjacent ring sections 32 corresponding to the slit 37 are not deformed to come in contact with each other and a short circuit can be suppressed. If the projections 39 are not formed as shown in FIGS. 14*a* and 14*b*, the upper and lower ring sections 32 are deformed to come in contact with each other as shown in FIG. 14*a*. If the projections 39 are formed, deformation of the upper and lower ring sections 32 is suppressed and the ring sections 32 do not come in contact with each other as shown in FIG. 13*a*.

As shown in FIG. 2, because each ring connecting section 31 of the ring main body can be disposed in a position at an angle of about 45° with respect to a straight line connecting the terminal 35 and the terminal 35, the ring sections 32 can be miniaturized with respect to a mounting area. In other words, if the ring sections 32 are disposed in a corner portion 43 of a square mounting portion (not shown) in which the ring sections 32 are inscribed, the mounting area can be reduced.

Because the ring connecting sections 31 are provided with the grooves 42 for bending, the ring connecting sections 31 can be bent easily and accurately, the ring sections 32 are not bent, and cracks are not produced in the ring connecting sections 31. Especially because each groove 42 is formed in the direction (V) perpendicular to the center line (C) connecting the centers (O) of the ring sections 32 connected by the ring connecting section 31 and adjacent to each other, the ring sections 32 can accurately be placed one on top of another.

The terminals 35 of the coil section 34 are formed to have the steps 30 in the plurality of ring sections 32 formed of the metallic flat plate disposed in a plane. The step 30 formed on one terminal 35 and the step 30 formed on the other terminal 35 are arranged in such directions as to approach each other in a vertical direction when the ring sections 32 are placed one on top of another in a same phase. Therefore, the bent portions of the terminals 35 are disposed in a vicinity of a center in a height direction of the coil section 34 and ease of use in mounting is excellent. If the steps 30 are not formed, the coil section 34 is distorted in forming the package member 36 and the terminals 35 are less likely to be disposed in the vicinity of the center.

Especially, in the coil section 34 in which the ring connecting sections 31 are bent and the ring sections 32 are placed one on top of another, because the end sections of the arc-shaped portions 38 of the ring sections 32 formed with the terminals 35 can be disposed in opposed positions with respect to the centers (O) of the ring sections 32, orientations of the terminals 35 do not need to be considered in mounting and ease of use is excellent.

At this time, by providing each terminal 35 on the extension line (E) extending from the center (O) of the ring section 32 toward the end section of the arc-shaped portion 38 formed with the terminal 35, the terminal 35 can be disposed in line with the center (O) of the ring section 32 and the end section of the arc-shaped portion 38, the terminals 35, 35 are accurately disposed in the opposed positions with respect to the centers (O) of the ring sections 32, orientations of the terminals 35 do not need to be considered in mounting, and ease of use is further improved.

The package member 36 has an outside shape of a prism. Because the ring connecting section 31 formed at one end section is disposed in the corner portion 43 of the package member 36 and the ring connecting section 31 formed at the other end section is disposed between the corner portions 43, 43 of the package member 36 (portion 44), outer dimensions can be reduced and miniaturization can be achieved.

The package member 36 is pressure formed by using the metal mold 49. Because the compacted powder bodies 45 forming the package member 36 are solid bodies, an amount of the compacted powder body 45 between the metal mold 49 and the coil section 34 is less liable to vary in the re-pressure forming, a thickness of the coating of the package member 36 is liable to be uniform throughout the entire periphery of the coil section 34, and variations in characteristics can be suppressed. Because the coil section 34 can be supported by the compacted powder bodies 45, the coil section 34 can accurately be positioned to prevent faulty forming of the package member 36.

At this time, because the high hardness portion of the compacted powder body 45 firmly supports one face of the coil section 34, a positional displacement of the coil section 34 is less liable to occur in the re-pressure forming and the coil section 34 can accurately be positioned.

In the re-pressure forming, the compacted powder bodies 45 are provided with the low hardness portions of such hardness that the compacted powder body 45 loses its shape and the compacted powder bodies 45 are re-pressure formed such that the low hardness portions cover the coil section 34. Therefore, the low hardness portions of the compacted powder bodies 45 lose their shapes while the crumbled low hardness portions of the compacted powder bodies 45 are closely filled the empty space between the coil section 34 and the high hardness portion. As a result, a magnetic gap can be reduced to enhance magnetic efficiency.

Moreover, the thickness (a distance between the coil section 34 and a surface of the package member 36) of the skin of the package member 36 in which the coil section 34 is encapsulated is smaller than the diameter of the through hole 33 of the coil section 34. The upper face portion 50 of the package member 36 corresponding to the upper portion of the coil section 34 and the lower face portion 51 of the package member 36 corresponding to the lower portion of the coil section 34 are formed to be thin to make the whole package member 36 thin. Although the package member 36 is made thin, generation of magnetic saturation can be suppressed in the upper face portion 50 and the lower face portion 51 because the densities of the upper face portion 50 and lower face portion 51 are higher than the density of the intermediate portion 52.

In other words, an inside of the through hole 33 of the coil section 34 corresponds to the intermediate portion 52 of the package member 36. Because the densities of the upper face portion 50 and lower face portion 51 are higher than the density of the intermediate portion 52, if a magnetic flux passing through the through hole 33 passes through the upper face portion 50 and the lower face portion 51 smaller than the diameter of the through hole 33, magnetic permeability can be increased by an amount by which the densities of the upper face portion 50 and lower face portion 51 are higher than the density of the intermediate portion 52 in the upper face portion 50 and the lower face portion 51. Therefore, the package member 36 can be made thin without generating the magnetic saturation in the upper face portion 50 and the lower face portion 51.

According to the producing method of the invention, the above-described coil component can be produced.

As described above, according to the one embodiment of the invention, because the ring sections 32 are formed of the metallic flat plate, the coil component operates in the high-frequency region, ensures the inductance and the infinitesimal direct-current resistance, and is adaptable to the large current.

Second Embodiment

Figure 16:
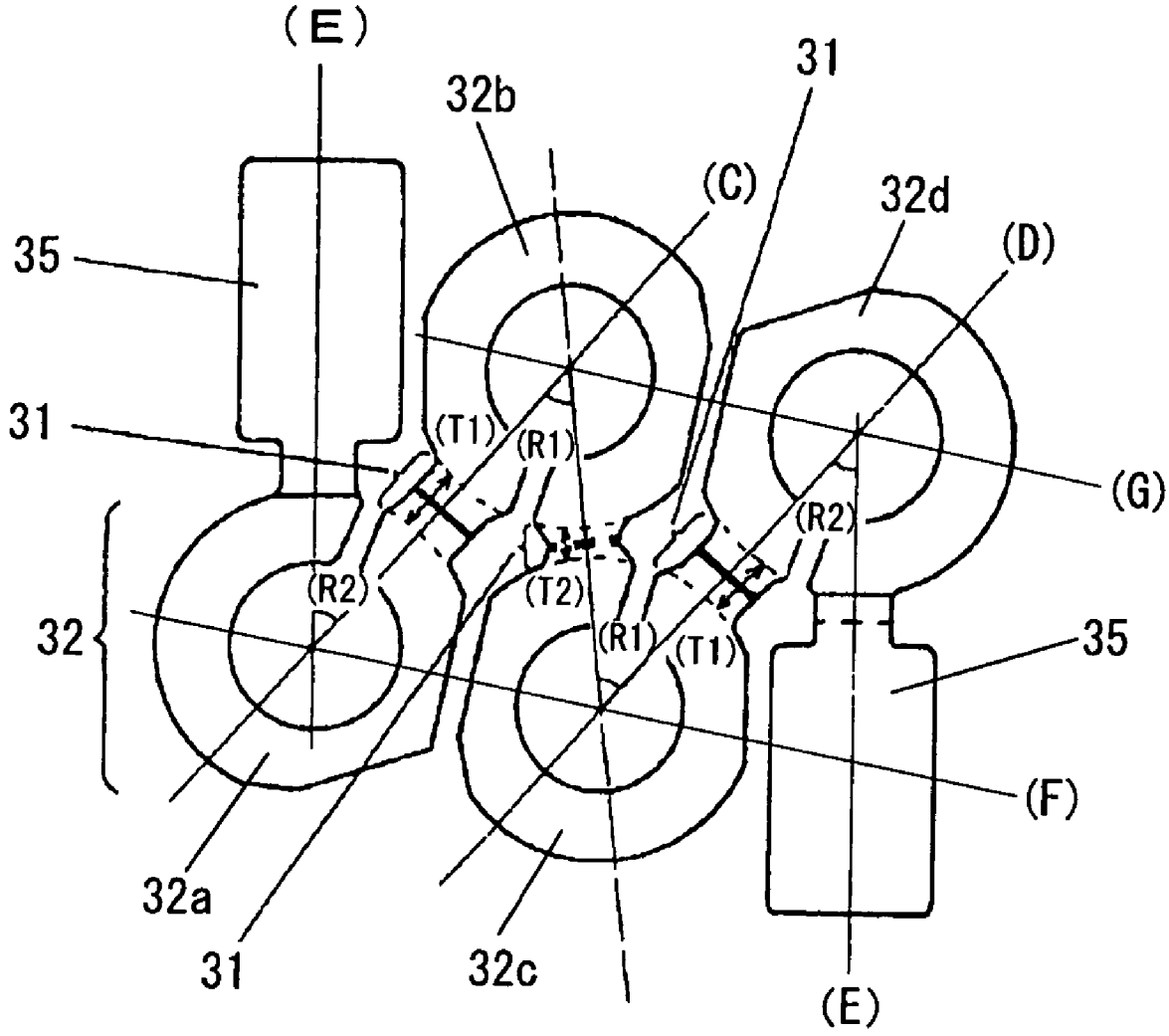
FIG. 16 is a plan view of four ring sections formed of a metallic flat plate disposed in a plane of a coil component according to a second embodiment.

Although the three ring sections 32 are used in the first embodiment of the invention, four ring sections 32 may be used as shown in FIG. 16.

The four ring sections 32*a* to 32*d* of the second embodiment are disposed to have predetermined positional relationships. In other words, as shown in FIG. 16, in the second embodiment, a line (C) connecting centers of ring sections 32*a* and 32*b* disposed in upper and lower sides and a line (D) connecting centers of the ring sections 32*c* and 32*d* disposed in upper and lower sides are parallel to each other. A line (G) connecting the centers of the ring sections 32*c* and 32*d* disposed in the upper side and a line (F) connecting the centers of the ring sections 32*a* and 32*c* disposed in the lower side are parallel to each other. Therefore, an angle R1 connecting the centers of the ring sections 32*a*, 32*b*, and 32*c* and an angle R1 connecting the centers of the ring sections 32*b*, 32*c*, and 32*d* are the same and 48°. Angles (R2) formed by extension lines (E) passing through central portions of terminals 35 and center lines (C) and (D) are 42° and smaller than the angles (R1). The center lines (C) and (F), (F) and (D), (C) and (G), and (G) and (D) intersect each other at angles of about 60°. A distance between the center line (G) and the center line (F) is set at such a dimension that outer peripheral edges of the upper and lower ring sections 32*a* and 32*b*, 32*c* and 32*d* do not overlap each other. A distance between the center line (C) and the center line (D) is set at such a dimension that the outer peripheral edges of the left and right ring sections 32*b* and 32*d*, 32*a* and 32*c* overlap each other. Therefore, the opposed outer peripheral edges of the ring sections 32*b* and 32*d*, 32*a* and 32*c* are cut off by small amounts.

If a disposition pattern of the above-described ring sections 32*a* to 32*d* is repeated, more than four ring sections can be disposed and the desired inductance can be obtained.

Figure 17:
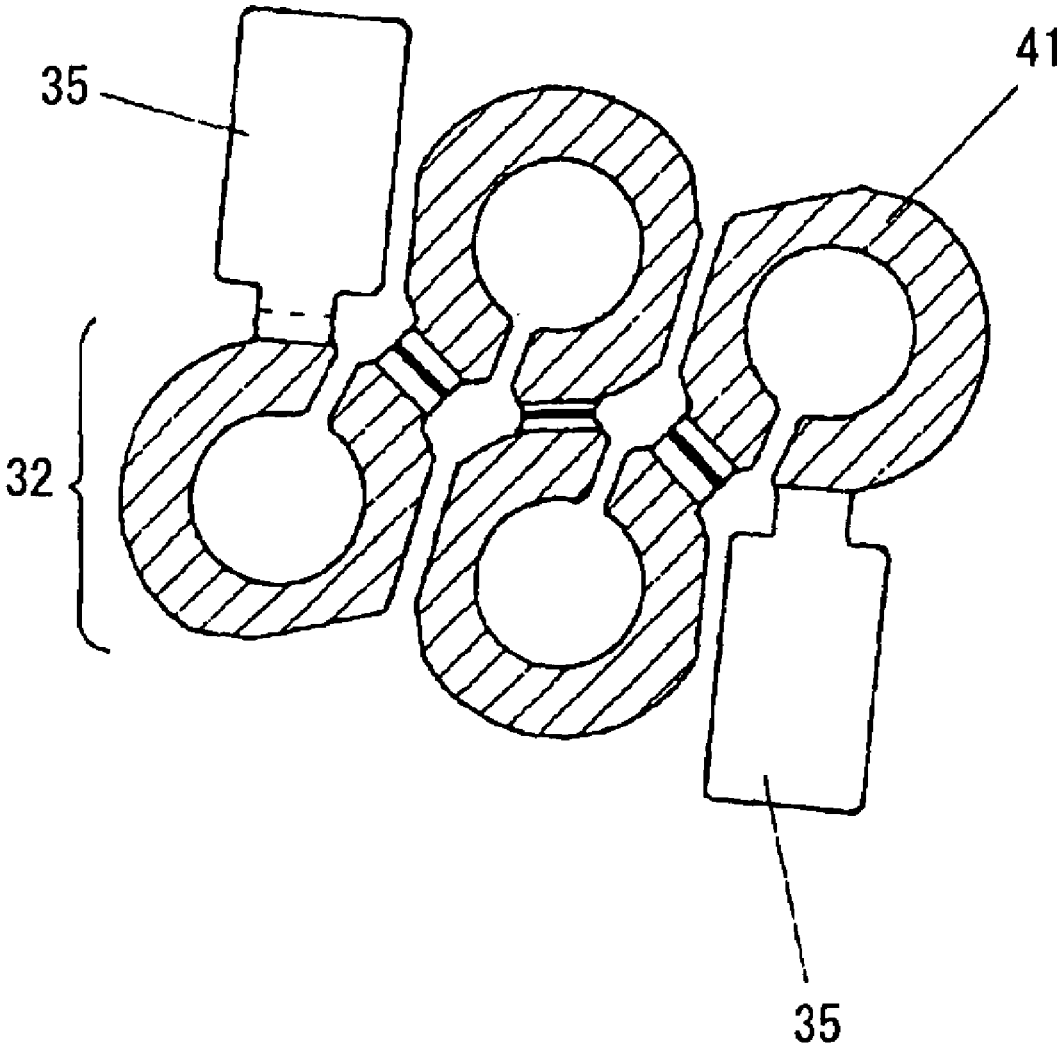
FIG. 17 is a plan view of the ring sections provided with insulating coating layers.
Figure 18A:
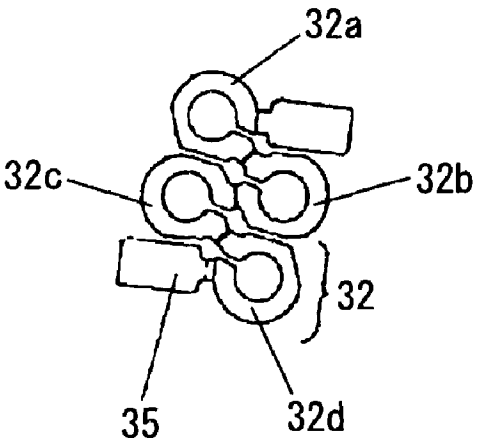
FIG. 18*a* to 18*d* are process diagrams of bending the ring sections.
Figure 18B:
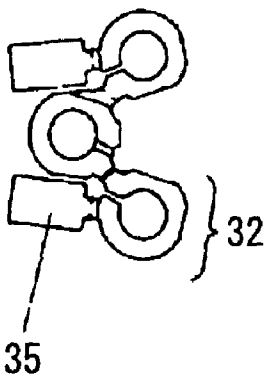
Figure 18C:
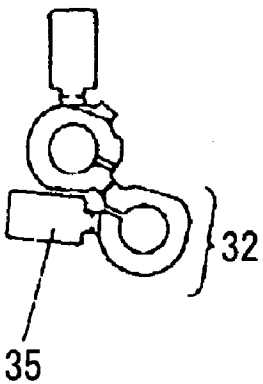
Figure 18D:
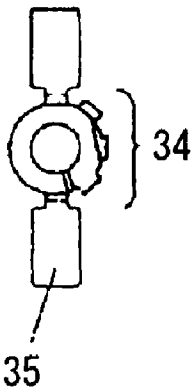
Figure 19:
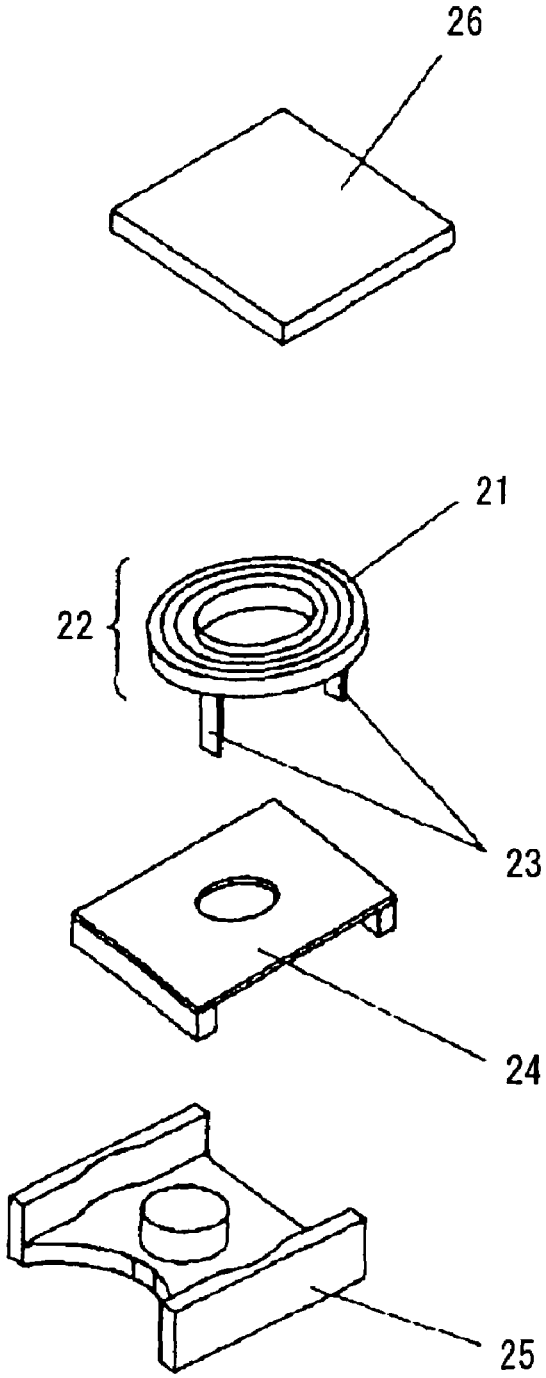
FIG. 19 PRIOR ART
FIG. 19 is an exploded perspective view of a conventional coil component.

As shown in FIG. 17, the four ring sections 32 excluding the ring connecting sections 31 are formed with insulating coating layers 41. As shown in FIGS. 18*a* to 18*d*, the ring connecting sections 31 are bent to form a coil section 34. In other words, the ring connecting section 31 is bent such that surface sides of the ring sections 32*b* and 32*c* face each other (FIG. 18*b*). Then, the ring section 32*a* is folded back toward an underside and placed under the ring section 32*c* (FIG. 18*c*). Lastly, the ring section 32*d* is folded back toward a surface side and placed on the ring section 32*b* (FIG. 18*d*).

At this time, by setting a length (T1) of the ring connecting section 31 formed at one end section of the arc-shaped portion 38 to be greater than a length (T2) of the ring connecting section 31 formed at the other end section, increase in an outside diameter of the coil section 34 can be suppressed, overlaps of the ring sections 32 formed of the metallic flat plate disposed in the plane can be reduced, and the direct-current resistance can be reduced while ensuring the inductance of the coil section 34.

Because the method of encapsulating the resin has been described in detail in the above first embodiment, the description will be omitted.

INDUSTRIAL APPLICABILITY

As described above, according to the invention, because the ring sections are formed of the metallic flat plate, it is possible to provide the coil component which operates in the high-frequency region, ensures the inductance and infinitesimal direct-current resistance, and is adaptable to the large current.

Furthermore, the sum of the angle formed by the center line connecting the centers of the ring sections connected by the ring connecting section and adjacent to each other and the center line and the angles each formed by the center line of the ring section connected to the terminal and the extension line extending from the center of the ring section toward the end section formed with the terminal is 180°. Therefore, it is easy to place the ring sections one on top of another.

Especially, in the coil section in which the ring connecting sections are bent to place the ring sections one on top of another, because the end sections of the arc-shaped portions of the ring sections formed at the terminals can be disposed in the opposed positions with respect to the centers of the ring sections, orientations of the terminals do not need to be considered in mounting and ease of use is excellent.

At this time, because each ring connecting section can be disposed in a position at an angle of about 45° with respect to a straight line connecting the end sections formed with the terminals, miniaturization with respect to a mounting area can be achieved. In other words, if the ring connecting sections are disposed in a corner portion of the square mounting portion in which the ring sections are inscribed, the mounting area can be reduced.

If the package member is formed into the prism shape, by disposing the ring connecting section in the corner portion, the outer dimensions of the package member can be reduced and miniaturization can be achieved.

For the above reasons, the invention can provide the coil component useful in a field of the electronic apparatus and the method of producing the coil component.

What is claimed is:

1. A method of producing a coil component, comprising:

forming a coil section having a through hole, and covering the coil section with a package member and causing terminals connected to the coil section to project from the package member, wherein the step of forming the coil section comprises:

forming a plurality of ring sections comprising a metallic plate in a plane, said ring sections connected to each other by ring connecting sections, and bending the ring sections at the ring connecting sections such that the ring sections are placed one on top of another, and such that terminal sections extend from opposite sides of said coil section with respect to the centers of the ring connecting sections;

each ring section comprises an arc-shaped portion having a slit formed by cutting a part of the ring section, and a winding direction of each ring section is opposite from each adjacent ring section, and end sections of the arc-shaped portion of the ring sections are connected to each other through the ring connecting sections;

each terminal section is located at an end section of the arc-shaped portion of the ring section where the ring sections are not connected to each other;

the ring sections are formed such that the coil component comprises outer rings connected to said terminals and at least one inner ring, an extension line extending from a center of each of the outer rings extends along a substantially center portion of a corresponding terminal connected to said outer ring; and a sum of angles formed (1) at a center of the at least one inner ring by center lines connecting said center of the inner ring with centers of each adjacent ring section, and (2) at a center of each of the outer rings by a centerline connecting the center of the outer ring with an adjacent inner ring and the extension line extending from the center of the outer ring along the substantially center portion of the corresponding connected terminal, is approximately 180°.

2. The method of producing a coil component according to claim 1, wherein each ring connecting section is formed with a groove for bending.

3. The method of producing a coil component according to claim 2, wherein each groove is formed in a direction perpendicular to a center line connecting centers of the ring sections adjacent to each other and connected by the ring connecting section.

4. The method of producing a coil component according to claim 1, wherein a projection extending toward the slit is formed at each end section of the arc-shaped portion of the ring section where the ring sections are connected to each other.

5. The method of producing a coil component according to claim 1, wherein the ring sections have substantially equal outside diameters.

6. The method of producing a coil component according to claim 1, wherein peripheral edge portions of the ring sections are chamfered.

7. The method of producing a coil component according to claim 1, wherein a step is formed on each terminal provided at the end section of the arc-shaped portion of the ring section where the ring sections are not connected to each other, and the steps formed on one terminal and the other terminal are arranged to be in such directions that the terminals approach each other when the ring sections are placed one on top of another in a same phase.

8. The method of producing a coil component according to claim 1, wherein each ring section, excluding the ring connecting section, is provided with an insulating coating layer.

9. The method of producing a coil component according to claim 1, wherein a length of the ring connecting section formed at one end section of the arc-shaped portion of the ring section is greater than a length of the ring connecting section formed at the other end section.

10. The method of producing a coil component according to claim 1, wherein the package member has an outside shape of a prism, each ring connecting section is located at a corner portion of the package member, and each terminal is located between the corner portions of the package member.

11. The method of producing a coil component according to claim 1, wherein the plurality of ring sections formed of a metallic plate in a plane are formed by etching or die-cutting.

12. The method of claim 1, wherein a plurality of inner rings are formed, such that the sum of angles formed (1) at centers of each of the inner rings by lines connecting said centers of each of the inner rings with centers of each adjacent ring, respectively, and (2) at centers of each of the outer rings by a line connecting a center of the outer ring with a center of an adjacent inner ring and an extension line extending from the center of the outer ring along the substantially center portion of the corresponding connected terminal, is approximately 180°.

* * * * *